US010245838B2

(12) United States Patent
Hizawa et al.

(10) Patent No.: US 10,245,838 B2
(45) Date of Patent: Apr. 2, 2019

(54) LIQUID EJECTING APPARATUS

(71) Applicant: SEIKO EPSON CORPORATION, Tokyo (JP)

(72) Inventors: Shunichi Hizawa, Matsumoto (JP); Tomoyuki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 15/631,712

(22) Filed: Jun. 23, 2017

(65) Prior Publication Data

US 2018/0009227 A1 Jan. 11, 2018

(30) Foreign Application Priority Data

Jul. 6, 2016 (JP) ..... 2016-133992

(51) Int. Cl.

| | |
|---|---|
| ***B41J 2/17*** | (2006.01) |
| ***B41J 2/175*** | (2006.01) |
| ***B41J 11/00*** | (2006.01) |
| ***B41J 2/165*** | (2006.01) |
| *B41J 2/185* | (2006.01) |

(52) U.S. Cl.

CPC ..... *B41J 2/1721* (2013.01); *B41J 2/16508* (2013.01); *B41J 2/16517* (2013.01); *B41J 2/16523* (2013.01); *B41J 2/17513* (2013.01); *B41J 11/0065* (2013.01); *B41J 2002/16582* (2013.01); *B41J 2002/1856* (2013.01)

(58) Field of Classification Search

CPC .. B41J 2/1721; B41J 2/17513; B41J 11/0065; B41J 2/16517; B41J 2/16508; B41J 2/16523; B41J 2002/16582; B41J 2002/1856

See application file for complete search history.

(56) References Cited

U.S. PATENT DOCUMENTS

2007/0252864 A1 11/2007 Uchino
2009/0256884 A1 10/2009 Aoki
2013/0135401 A1* 5/2013 Kobayashi ..... B41J 2/175 347/85

FOREIGN PATENT DOCUMENTS

JP 2007-296757 A 11/2007
JP 2010-012652 A 1/2010

* cited by examiner

*Primary Examiner* — Lamson D Nguyen
(74) *Attorney, Agent, or Firm* — Workman Nydegger

(57) ABSTRACT

A liquid ejecting apparatus includes a liquid ejecting head ejecting liquid onto a medium transported on a transport path extending in a depth direction, a carriage holding the liquid ejecting head and reciprocally moving in a width direction so as to cross the transport path, and a waste liquid containing portion containing waste liquid discharged from the liquid ejecting head. The carriage includes a plurality of liquid containers that contain the liquid and are mounted on the carriage in such a manner that a plurality of the liquid containers are arranged side by side with each other in the depth direction. A portion of the carriage overlaps the waste liquid containing portion in a vertical direction when the liquid ejecting head is outside the transport path.

9 Claims, 5 Drawing Sheets

LIQUID EJECTING APPARATUS

BACKGROUND

1. Technical Field

The entire disclosure of Japanese Patent Application No: 2016-133992, filed Jul. 6, 2016 is expressly incorporated by reference herein in its entirety.

The present invention relates to liquid ejecting apparatuses, such as printers.

2. Related Art

An example of a liquid ejecting apparatus is an ink jet type printer that performs printing by ejecting liquid. The liquid is supplied from an ink cartridge attached at an end of the apparatus body and ejected from a recording head held in a carriage that moves in a reciprocating manner (for example, JP-A-2010-12652).

Such a printer may include a waste liquid tank for containing ink that is discharged as a waste liquid from the recording head. Such a printer is sometimes accompanied by a problem that the apparatus body becomes larger due to the fact that the waste liquid tank needs to be disposed within the apparatus body in addition to the ink cartridges.

Note that this problem is not peculiar to printers that perform printing by ejecting ink, but is by and large common to liquid ejecting apparatuses that include liquid containers for containing liquid to be ejected and a waste liquid containing portion for containing waste liquid.

SUMMARY

An advantage of some aspects of the invention is that a liquid ejecting apparatus is provided in which an increase in size due to provision of a waste liquid containing portion is suppressed.

Implementation means and advantageous effects will now be described. An liquid ejecting apparatus includes a liquid ejecting head ejecting liquid onto a medium transported on a transport path extending in a depth direction, a carriage holding the liquid ejecting head and reciprocally moving in a width direction so as to cross the transport path, and a waste liquid containing portion containing waste liquid discharged from the liquid ejecting head, in which the carriage includes a plurality of liquid containers that contain the liquid and are mounted on the carriage in such a manner that a plurality of the liquid containers are arranged side by side with each other in the depth direction, and a portion of the carriage overlaps the waste liquid containing portion in a vertical direction when the liquid ejecting head is outside the transport path.

With this configuration, a plurality of the liquid containers containing liquid are mounted on the carriage in such a manner the liquid containers are arranged side by side in the depth direction. Thereby, the width of the apparatus can be reduced compared with an apparatus in which the liquid containers are arranged in the width direction. In addition, although the carriage becomes longer in the depth direction due to a plurality of the liquid containers mounted thereon, disposing a portion of the carriage at a position overlapping the waste liquid containing portion in the vertical direction can suppress an increase in the size of the apparatus in the depth direction. Thus, the increase in the size of the apparatus caused by disposing the waste liquid containing portion can be suppressed. Note that the increase in the size of the apparatus in the depth direction can be efficiently suppressed by making the front edge or rear edge of the carriage overlap the waste liquid containing portion in the vertical direction when the liquid ejecting head is outside the transport path.

In the liquid ejecting apparatus, the liquid ejecting head protrudes downward from a bottom of the carriage and is positioned side by side with the waste liquid containing portion in the depth direction when the liquid ejecting head is outside the transport path. With this configuration, the increase in the size of the carriage can be suppressed by making the liquid ejecting head protrude from the bottom of the carriage and by disposing the liquid ejecting head protruding from the carriage side by side with the waste liquid containing portion in the depth direction when the carriage is outside the transport path. Thus, the height of the apparatus can be reduced by reducing the vertical distance between the carriage and the waste liquid containing portion.

In the liquid ejecting apparatus, which further includes a liquid receiving portion, the liquid ejecting head has a nozzle that ejects the liquid, the liquid receiving portion is disposed outside the transport path and receives the liquid discharged from the nozzle, and the carriage has an end in the width direction and the end overlaps the transport path in the vertical direction when the nozzle is at a position opposing the liquid receiving portion.

With this configuration, if the whole portion of the carriage is disposed outside the transport path when the liquid ejecting head is outside the transport path, then the length of the movement path of the carriage inevitably becomes larger, leading to an increase in the size of the apparatus in the width direction. However, the increase in the size of the apparatus in the width direction can be suppressed by making a widthwise end edge of the carriage overlap the transport path when the liquid ejecting head is outside the transport path.

In the liquid ejecting apparatus, which further includes a liquid receiving portion and a suction mechanism, the liquid ejecting head has a nozzle that ejects the liquid, the liquid receiving portion is disposed outside the transport path and receives the liquid discharged from the nozzle, the suction mechanism sucks the liquid from the liquid ejecting head via the liquid receiving portion, and the suction mechanism and the waste liquid containing portion are disposed at positions sandwiching the liquid receiving portion.

With this configuration, the size of the carriage is increased in the depth direction by mounting, on the carriage, the liquid containers that are arranged side by side in the depth direction. In this case, the increase in the height and the width of the apparatus can be suppressed by arranging the waste liquid containing portion, the liquid receiving portion, and the suction mechanism side by side in the depth direction.

In the liquid ejecting apparatus, the carriage has a mounting portion on which the liquid containers are detachably mounted and an operating portion used for installation and removal of each of the liquid containers, the carriage moves reciprocally between a first end and a second end of a movement path that crosses the transport path in a grade separation manner, and the operating portion is disposed at a first end side of the mounting portion.

With this configuration, disposing the operating portion on the first end side of the mounting portion causes the carriage to increases in size toward the first end side, thereby extending the length of the movement path of the carriage between the transport path and the first end. However, even if the carriage increases in size toward the first end, the length of the movement path between the transport path and the second end does not need to increase, by making the expanded portion of the carriage overlap the transport path in the vertical direction when the liquid ejecting head is in between the transport path and the second end. Thus, the increase in the size of the apparatus body toward the second end can be suppressed.

In the liquid ejecting apparatus, the carriage has a mounting portion on which the liquid containers are detachably mounted and moves reciprocally between a first end and a second end of a movement path that crosses the transport path in a grade separation manner, the liquid container has an operating portion used for installation and removal of each of the liquid containers on the mounting portion, and the operating portion of each of the liquid containers that are mounted on the mounting portion is disposed at a first end side of the mounting portion.

Disposing the operating portion on the first end side of the mounting portion causes the carriage to increase in size toward the first end side, thereby extending the length of the movement path of the carriage between the transport path and the first end. With this configuration, however, even if the carriage increases in size toward the first end, the length of the movement path between the transport path and the second end does not need to increase, by making the expanded portion of the carriage overlap the transport path in the vertical direction when the liquid ejecting head is in between the transport path and the second end. Thus, the increase in the size of the apparatus body toward the second end can be suppressed.

In the liquid ejecting apparatus, the waste liquid containing portion includes a waste liquid container that contains the waste liquid and an installation room in which the waste liquid container is detachably installed from a front side in the depth direction. With this configuration, the waste liquid containing portion has the waste liquid container that is detachably installed in the installation room. Thus, replacing the waste liquid container can increase the amount of waste liquid to be received. Thus, it is not necessary to increase the size of the waste liquid containing portion in order to increase the amount of waste liquid to be received. In addition, the waste liquid container is installed from the front side in the depth direction, which improves operability when the waste liquid container is replaced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Now, an embodiment of the liquid ejecting apparatus will be described with reference to the drawings. The liquid ejecting apparatus is, for example, an ink jet type printer that performs recording (printing) by ejecting ink, which is an example of liquid, onto a medium, such as a sheet of paper.

Figure 1:
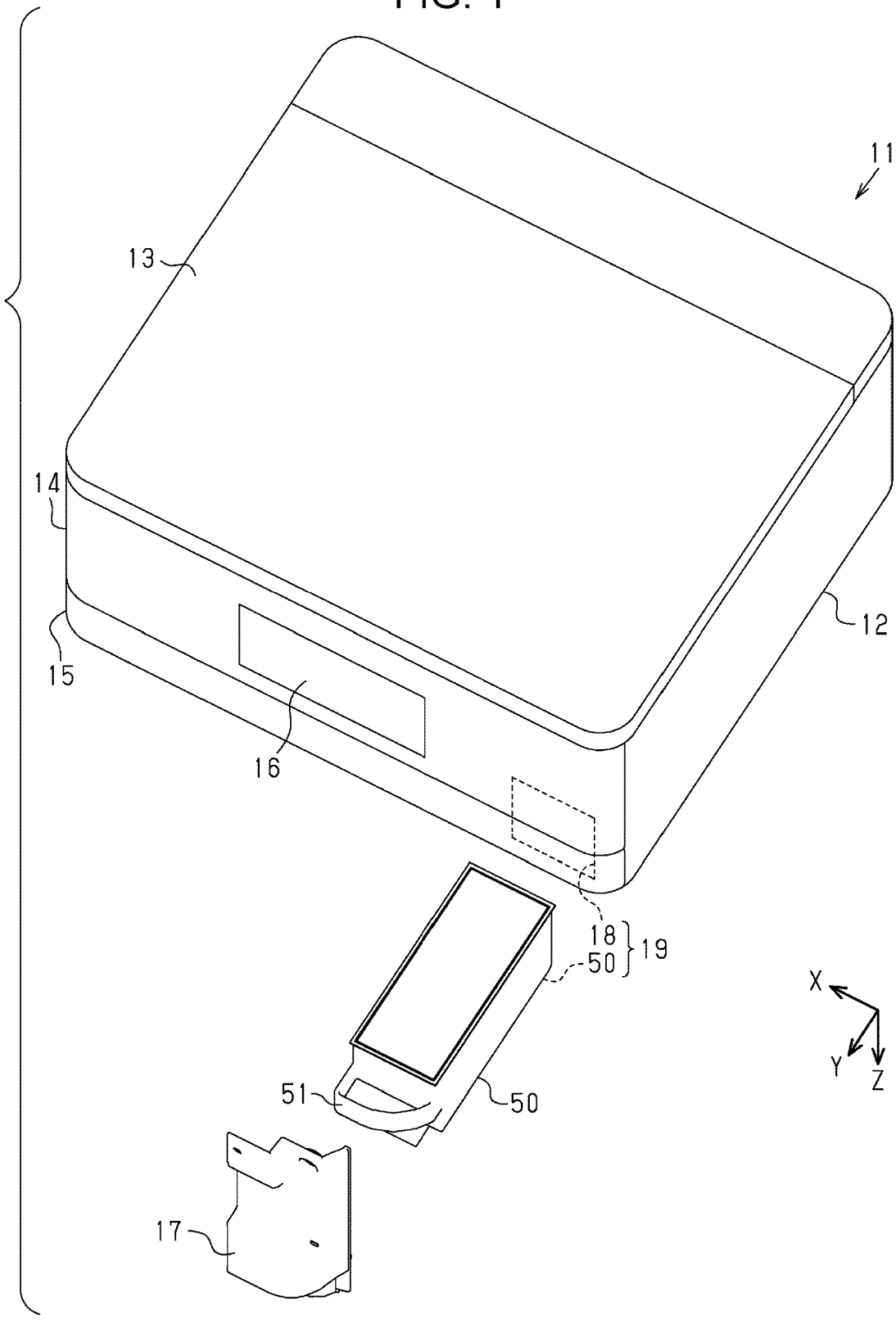
FIG. 1 is a perspective view illustrating a liquid ejecting apparatus according to one embodiment.

As illustrated in FIG. 1, a liquid ejecting apparatus 11 includes a housing 12 that has respective predetermined lengths in height, depth, and width in a state in which the liquid ejecting apparatus 11 is placed for use. An opening/closing lid 13, an opening/closing panel 14, and an opening/closing cover 15 are turnably attached to the housing 12. When a side to which the opening/closing lid 13 is attached is referred to as the top side of the housing 12 and a portion in which the pivot of the opening/closing lid 13 is disposed is referred to as a rear portion of the housing 12, the opening/closing lid 13 is pivotally turned with the rear end thereof as the pivot.

In the present embodiment, when the housing 12 is assumed to be placed on a horizontal plane, the width direction and the depth direction are substantially horizontal, and the Z axis represents the direction of gravity. The Y axis represents a direction from a deep side (rear side) toward a front side in the depth direction. In addition, the depth direction is represented by the X axis that intersects the Z axis and the Y axis. In other words, the width direction, the gravity direction, and the depth direction represent different directions, and the X axis, the Z axis, and the Y axis are coordinate axes representing width, height, and depth, respectively.

The opening/closing panel 14 attached to the front side of the housing 12 opens or closes by being pivotally turned about 90 degrees with the top edge thereof as the pivot. The opening/closing panel 14 includes a panel 16 for operating the liquid ejecting apparatus 11 and displaying the operational status, etc., of the liquid ejecting apparatus 11. In addition, the opening/closing cover 15 attached to the front side of the housing 12 below the opening/closing panel 14 opens or closes by being pivotally turned 90 degrees with the bottom edge thereof as the pivot.

When the opening/closing panel 14 and the opening/closing cover 15 open, a container cover 17 is exposed. The container cover 17 is detachably installed in the housing 12. The container cover 17 is a lid member that covers the opening of an installation room 18 in which a waste liquid container 50 is detachably installed. The waste liquid container 50 of the embodiment, which is a container for containing waste liquid generated in the liquid ejecting apparatus 11, is detachably installed in the installation room 18 from the front side in the depth direction. Installing the waste liquid container 50 in the installation room 18 forms a waste liquid containing portion 19. In other words, the liquid ejecting apparatus 11 includes the waste liquid containing portion 19 that includes the waste liquid container 50 and the installation room 18. Incidentally, providing the waste liquid container 50 with a handle 51 for holding it during installation or removal makes it easier to install or remove the waste liquid container 50.

The installation room 18 opens in a direction toward the front side. The waste liquid container 50 is installed in the installation room 18 through this opening. The container cover 17 has a function of holding the waste liquid container 50 lest the installed waste liquid container 50 should come out of the installation room 18. The container cover 17 may be fixed to the housing 12 by screws or the like so as not to allow the waste liquid container 50 to be installed or removed easily. In this case, a user who generates a larger amount of the waste liquid replaces the waste liquid container 50 only when waste liquid management requires to do so. On the other hand, in the case that it is desirable to install or remove the waste liquid container 50 easily, the container cover 17 need not be provided.

Figure 2:
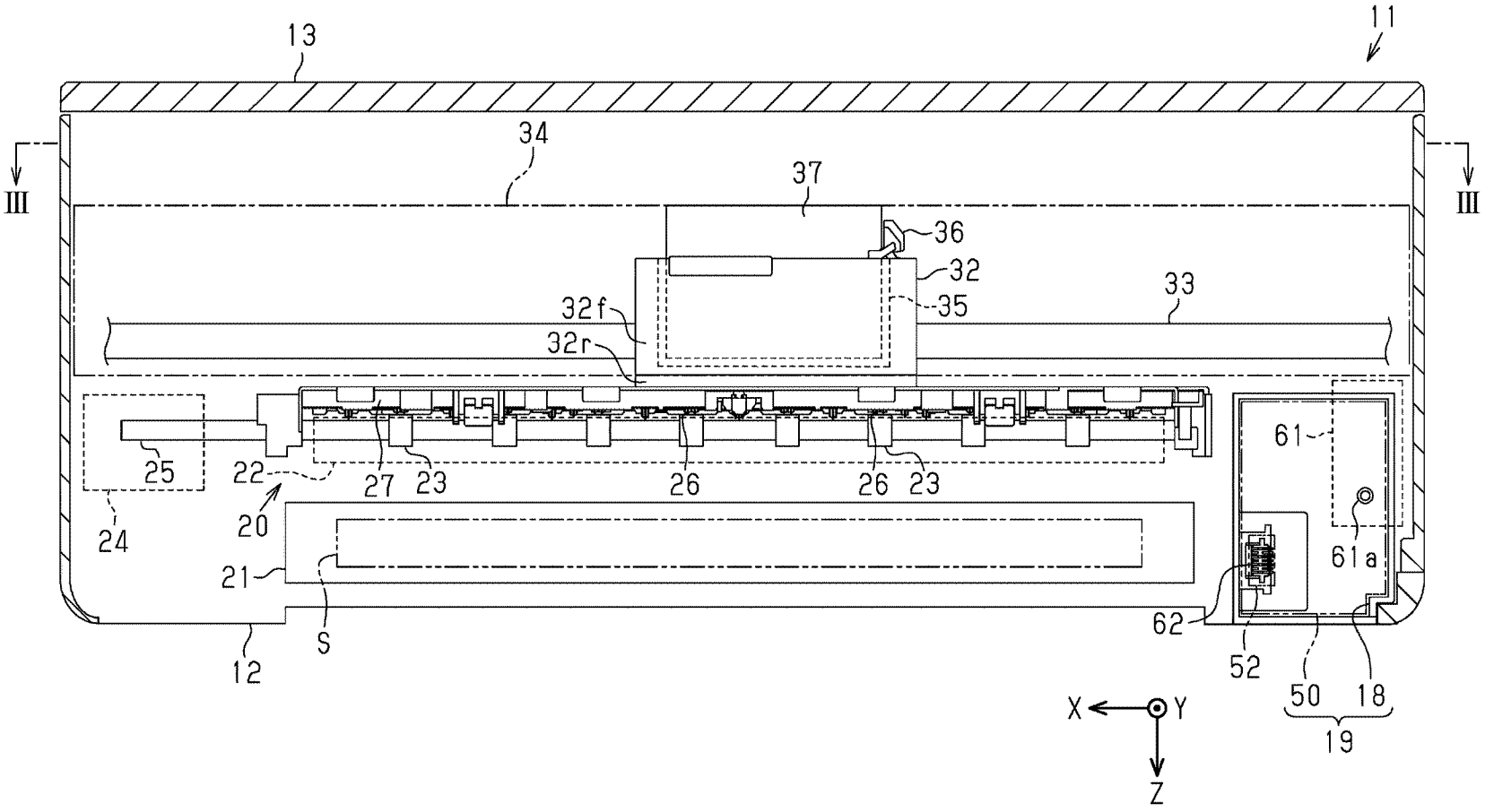
FIG. 2 is a cross-sectional view illustrating a schematic structure of the liquid ejecting apparatus in FIG. 1.

As illustrated in FIG. 2, the liquid ejecting apparatus 11 includes a media cassette 21 for containing and stacking a plurality of media S and also a transport mechanism 20 for transporting each of the media S. The transport mechanism 20 includes a medium support unit 22 for supporting a medium S near the center in the housing 12, discharge rollers 23 for transporting the medium S supported by the medium support unit 22 toward the front side, and a drive source 24 that is formed of a transport motor, etc. Moreover, the transport mechanism 20 has a feed mechanism (not shown) that picks up the media S one by one from a rear side of the media cassette 21 and reverses a medium S so as to feed it onto the medium support unit 22. The media cassette 21 is detachably installed at a position that is vertically above or below the medium support unit 22 (vertically below the medium support unit 22 in the embodiment).

A plurality of the discharge rollers 23 are provided in front of the medium support unit 22 in such a manner that the discharge rollers 23 are arranged in the width direction along a rotating shaft 25 that is rotationally driven by the drive source 24. A plurality of driven rollers 26 are provided above the discharge rollers 23 in such a manner that the driven rollers 26, which are supported by a support frame 27 extending in the width direction, are arranged in the width direction. The discharge rollers 23 rotate with a medium S sandwiched between the discharge rollers 23 and driven rollers 26, thereby discharging the medium S out of the housing 12. The discharge rollers 23 and the driven rollers 26 are disposed at a position side by side with the installation room 18 in the width direction.

A connection device 61 is provided deeper within the installation room 18. The connection device 61 has a connection pipe 61*a* that is connected to the waste liquid container 50 installed in the installation room 18. The waste liquid container 50 may include a circuit board 52 having a memory. When the circuit board 52 is provided in the waste liquid container 50, it is preferable that a terminal unit 62 that is electrically coupled to the circuit board 52 be provided deeper within the installation room 18. In this case, the connection pipe 61*a* and the terminal unit 62 preferably do not overlap each other in the vertical direction so that droplets of the waste liquid from the connection pipe 61*a*, if any, do not easily adhere to the terminal unit 62.

Figure 3:
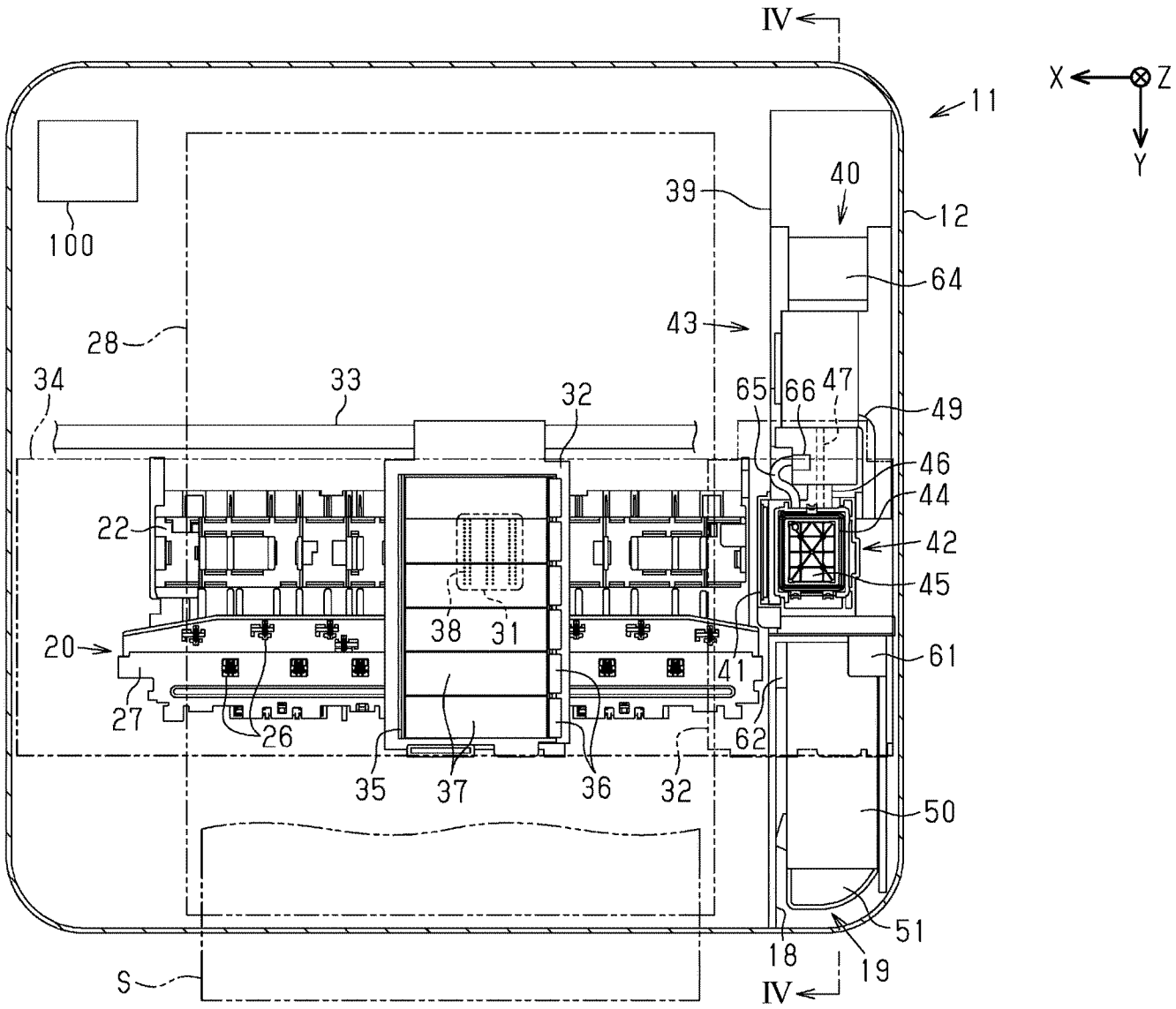
FIG. 3 is a cross-sectional view taken along III-III in FIG. 2.

As illustrated in FIG. 3, a transport path 28 of media S is provided near the center in the width direction, when viewed in plan view, in such a manner that the transport path 28 extends in the depth direction. The transport path 28 is formed of the medium support unit 22 and a plurality of other members (not shown). The transport mechanism 20 transports a medium S on the transport path 28 from the rear side toward the front side in the depth direction.

The liquid ejecting apparatus 11 includes a liquid ejecting head 31 that ejects liquid toward a medium S that is transported on the medium support unit 22, a carriage 32 that moves reciprocally in the width direction with the liquid ejecting head 31 held thereon, and a maintenance unit 40 for performing maintenance on the liquid ejecting head 31. A guide shaft 33 is disposed so as to be suspended in the housing 12 to guide the movement of the carriage 32. The liquid ejecting apparatus 11 also includes a control unit 100 disposed at an arbitrary position in the housing 12 for controlling operation of elements including the liquid ejecting head 31, the transport mechanism 20, and the maintenance unit 40.

A movement path 34 of the carriage 32 is disposed above the transport path 28 so as to cross over the transport path 28. The carriage 32 and the liquid ejecting head 31 alternately perform an outward movement from a first end (right end in FIG. 3) to a second end (left end in FIG. 3) of the movement path 34 and a homeward movement from the second end to the first end, thereby crossing the transport path 28 and reciprocally moving between the first end and the second end in the width direction.

The carriage 32 has a mounting portion 35 on which liquid containers 37 containing liquid are detachably mounted and also has operating portions 36 for installation and removal of the liquid containers 37. A plurality of the liquid containers 37 (six in the embodiment) are mounted on the mounting portion 35 so as to be arranged side by side in the depth direction. The liquid containers 37 are mounted on the carriage 32 in this manner. Each of the six liquid containers 37 according to the embodiment contains a different type of liquid (for example, different color ink) and the liquid contained in each liquid container 37 is supplied to the liquid ejecting head 31.

Each operating portion 36 is, for example, a lever or a button, etc., that is pushed so as to allow installation or removal of a corresponding one of the liquid containers 37. In the embodiment, a plurality of the operating portions 36, each corresponding to one of the liquid containers 37, are disposed side by side in the depth direction at the first end side (right hand side in FIG. 3) of the mounting portion 35.

The liquid ejecting head 31 has a plurality of nozzles 38 that eject liquid. The nozzles 38 are provided so as to correspond to different types of liquid. A number of nozzles 38 that eject the same type of liquid form a nozzle row in which the nozzles 38 are arranged in the depth direction. The liquid ejecting head 31, which is smaller in width, depth, and height than the carriage 32, is disposed, in the depth direction, in a deeper portion of the carriage 32 with respect to the center thereof. The liquid ejecting head 31 is disposed in the carriage 32 in a portion slightly closer to the first end than the center of the carriage 32 in the width direction.

The maintenance unit 40 is disposed outside the transport path 28 in such a manner that the maintenance unit 40 is arranged side by side with the medium support unit 22 in the width direction. A mounting frame 39 that supports the maintenance unit 40 is fixedly disposed on the first end side in the housing 12. The waste liquid containing portion 19 is disposed in front of the maintenance unit 40 in the depth direction.

The maintenance unit 40 includes a wiping member 41 for wiping the liquid ejecting head 31, a liquid receiving portion 42 for receiving the liquid discharged from the nozzles 38 as waste liquid, a suction mechanism 43 for sucking liquid from the liquid ejecting head 31 via the liquid receiving portion 42, and a drive source 64 formed of a motor and other components.

The wiping member 41 is disposed between the liquid receiving portion 42 and the medium support unit 22 in the width direction. The wiping member 41 moves up or down, by a driving force of the drive source 64, between a wiping position at which the liquid ejecting head 31 comes into contact with the wiping member 41 and a position that is lower than the wiping position. The liquid ejecting head 31, which moves in the width direction, comes into contact with the wiping member 41 that is positioned at the wiping position, thereby performing the wiping of the bottom surface at which the nozzles 38 open.

It is preferable to dispose the suction mechanism 43 and the waste liquid containing portion 19 at positions sandwiching the liquid receiving portion 42 in the depth direction. As illustrated with a two-dot chain line in FIG. 3, when the liquid ejecting head 31 is outside the transport path 28 (in the first end side of the transport path 28), it is preferable that the front edge of the carriage 32 (for example, a portion closer to the front than the liquid ejecting head 31) be disposed so as to overlap the rear edge of the waste liquid containing portion 19 in the vertical direction. In addition, when the nozzles 38 are positioned opposing the liquid receiving portion 42, it is also preferable that a widthwise end edge of the carriage 32 (the second end side edge) be disposed so as to overlap the transport path 28 (medium support unit 22) in the vertical direction.

In the embodiment, the position of the carriage 32 when the nozzles 38 oppose the liquid receiving portion 42 is referred to as "home position", as illustrated with a two-dot chain line in FIG. 3. The home position is set at the first end of the movement path 34.

Figure 4:
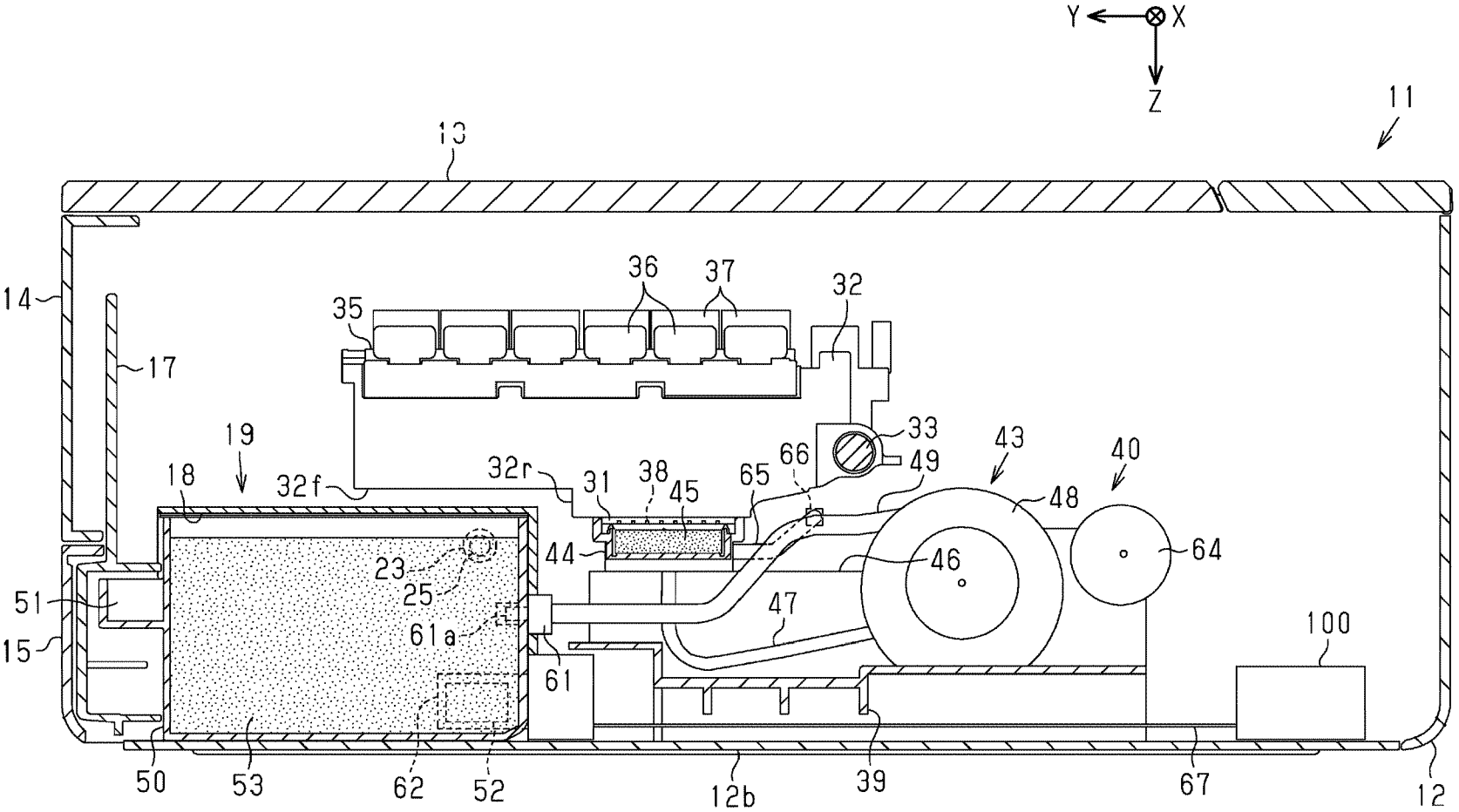
FIG. 4 is a cross-sectional view taken along IV-IV in FIG. 3.

As illustrated in FIG. 4, a rear portion 32*r* of the carriage 32 protrudes downward with respect to a front portion 32*f* that is positioned above the waste liquid containing portion 19. Moreover, the liquid ejecting head 31 protrudes further down from the rear portion 32*r* of the carriage 32. It is preferable that the rear portion 32*r* protruding downward from the carriage 32 and the liquid ejecting head 31 be disposed side by side with the waste liquid containing portion 19 in the depth direction when the liquid ejecting head 31 is outside the transport path 28 (at the home position in the embodiment). Disposing the front portion 32*f* of the carriage 32 as vertically close to the waste liquid containing portion 19 as possible can reduce the height of the housing 12.

The liquid receiving portion 42 includes a cap 44 that surrounds the nozzles 38 and forms a closed space when the liquid receiving portion 42 is in contact with the liquid ejecting head 31. The liquid receiving portion 42 also includes a liquid absorber 45 that is contained in the cap 44 and an elevating mechanism 46 that causes the cap 44 to move up and down. The suction mechanism 43 includes a suction channel 47 that is connected to the bottom of the cap 44, a suction pump 48 that is connected to the suction channel 47, a ventilation channel 65 that is connected to the rear side of the cap 44, and a vent valve 66 that is disposed at the end of the ventilation channel 65.

The elevating mechanism 46, the suction mechanism 43, and the vent valve 66 are driven by a driving force of the drive source 64. The suction pump 48 is connected to the connection pipe 61*a* via an introducing channel 49. Note that in FIG. 4, the cross sections of the elevating mechanism 46, the suction pump 48, the connection device 61, and the drive source 64 are omitted so as to show a simplified appearance.

When the liquid ejecting head 31 is at the home position, the elevating mechanism 46 raises the cap 44, and the cap 44 forms the closed space that surrounds the nozzles 38. This is referred to as "capping". The position of the cap 44 when the cap 44 moves up until it comes into contact with the liquid ejecting head 31 is referred to as "capping position".

When the vent valve 66 is open during the capping, the closed space is in communication with the atmosphere (outside) via the ventilation channel 65. In addition, when the vent valve 66 is closed during the capping, the closed space is substantially sealed so that drying up of the nozzles 38 is suppressed. When, for example, the power is off and the liquid ejecting head 31 does not eject liquid, it is preferable that the liquid ejecting head 31 be placed at the home position with the liquid ejecting head 31 being capped and the vent valve 66 being closed.

It is preferable that the vent valve 66 be disposed at a position higher than the position of the cap 44 during the capping (or at least higher than that of the liquid absorber 45 contained in the cap 44). By doing so, the waste liquid does not flow into the ventilation channel 65, or flow out through the ventilation channel 65 while the vent valve 66 is open. If the waste liquid enters the ventilation channel 65, the waste liquid may solidify in the ventilation channel 65 and prevent communication with the atmosphere even when the vent valve 66 is open.

When the suction pump 48 operates with the vent valve 66 open during the capping, the pressure in the closed space becomes negative, thereby allowing the liquid in the liquid ejecting head 31 to be sucked as waste liquid through the nozzles 38. The waste liquid that is discharged from the nozzles 38 by sucking is received by the cap 44 and sent through the liquid absorber 45, the suction channel 47, the introducing channel 49, and the connection pipe 61*a*. The waste liquid is then introduced into the waste liquid container 50. This is referred to as "suction cleaning". The suction cleaning is performed as a maintenance operation for discharging foreign matter, such as air bubbles, that has entered the liquid ejecting head 31.

After the suction cleaning, the vent valve 66 opens to release the negative pressure in the closed space, and the elevating mechanism 46 moves the cap 44 downward. With this state, the suction pump 48 operates to cause the waste liquid remaining in the cap 44 to be introduced into the waste liquid container 50. The suction operation with the cap 44 being separated from the liquid ejecting head 31 as described above is referred to as "dry suction"

It is preferable to perform wiping after the suction cleaning because of the waste liquid adhering to the vicinity of the opening of the nozzles 38. Flushing, by which liquid is ejected as waste liquid onto the cap 44, is preferably performed after the wiping in order to discharge foreign matter, such as air bubbles, from the nozzles 38. Dry suction is preferably performed after the flushing so as to introduce the waste liquid received by the cap 44 into the waste liquid container 50.

As described above, the waste liquid container 50 contains the liquid discharged from the liquid ejecting head 31 as waste liquid. The waste liquid container 50 may accommodate an absorber 53 capable of absorbing the waste liquid. In this case, the top surface of the absorber 53 is preferably located at a position lower than the top surface of the liquid absorber 45 of the cap 44 when the cap 44 is in the capping position. Thus, a situation in which the waste liquid in the waste liquid container 50 flows back toward the cap 44 during the capping and adheres to the liquid ejecting head 31 becomes less likely.

In addition, the top surface of the absorber 53 is preferably disposed at a position lower than the vent valve 66. This can prevent the waste liquid within the waste liquid container 50 from flowing back toward the cap 44 into the ventilation channel 65, which otherwise occurs due to head difference if the absorber 53 absorbs the waste liquid to near the top surface. This can also prevent the waste liquid from flowing out through the ventilation channel 65 when the vent valve 66 is open.

When the terminal unit 62 is provided in the installation room 18, the terminal unit 62 is connected to the control unit 100 via a communication cable 67. In this case, it is preferable that a space be provided between the mounting frame 39 for supporting the maintenance unit 40 and a bottom wall 12*b* of the housing 12, and the communication cable 67 be disposed in this space. Note that the suction channel 47, a portion of the introducing channel 49, or other members may be disposed in the space between the mounting frame 39 and the bottom wall 12*b*.

Next, the function of the liquid ejecting apparatus 11 as configured above will be described. The liquid ejecting apparatus 11 according to the embodiment includes a plurality of liquid containers 37 and the waste liquid container 50 installed in the housing 12, and thus the liquid ejecting apparatus 11 needs a space for accommodating them. Moreover, the space for accommodating the liquid containers 37 and the waste liquid container 50 needs to be provided without overlapping the space for the movement path 34 of the carriage 32 (region in which the carriage 32 moves).

In the embodiment, the carriage 32 becomes larger to the extent that the mounting portion 35 for mounting a plurality of the liquid containers 37 is provided on the carriage 32. Under these conditions, for example, disposing the waste liquid containing portion 19 at a position lateral to the movement region of the carriage 32 in the width direction results in an increase in the size of the housing 12 in the width direction. Alternatively, disposing the whole waste liquid containing portion 19 in front of the movement region of the carriage 32 results in an increase in the size of the housing 12 in the depth direction.

In the embodiment, on the other hand, a portion of the waste liquid containing portion 19 is disposed at a position overlapping the carriage 32 in the vertical direction at the home position. This suppresses an increase in the length of the movement path 34 in the depth direction. Moreover, a portion of the medium support unit 22 is disposed at a position overlapping the carriage 32 in the vertical direction at the home position. This suppresses an increase in the length of the movement path 34 in the width direction. Note that the liquid ejecting head 31 is smaller than the carriage 32. Thus, disposing the liquid ejecting head 31 at a position closer to the first end in the carriage 32 than the center thereof can reduce the length of the movement path 34 between the transport path 28 and the first end.

Furthermore, in the embodiment, when the liquid ejecting head 31 is located above the transport path 28, as illustrated in FIGS. 3 and 4, the liquid ejecting head 31 is side by side with the support frame 27 and the discharge rollers 23 in the depth direction. Here, as illustrated in FIG. 4, the top surface of the waste liquid container 50 is disposed, in the vertical direction, between the discharge rollers 23 and the front portion 32*f* of the carriage 32.

Here, if the vertical distance between the discharge rollers 23 and the front portion 32*f* and the vertical distance between the waste liquid container 50 and the front portion 32*f* are made as small as possible, dead space can be reduced. Reducing the dead space in the housing 12 allows the size of the apparatus body (housing 12) to be reduced.

Moreover, in the embodiment, the height of the maintenance unit 40 is reduced so that the top end of the suction pump 48 and the top end of the cap 44 when the cap 44 is in the capping position (the top end of a lip portion of the cap 44 that touches the bottom surface of the liquid ejecting head 31 where the nozzles 38 open) are disposed at a position almost as high as the top end of the waste liquid container 50 or the top end of the discharge rollers 23. In addition, if the top end of the cap 44 when the cap 44 is lowered and separated from the liquid ejecting head 31 is positioned almost as high as the periphery or axis of the rotating shaft 25, then the cap 44 can be raised or lowered efficiently.

In accordance with the above embodiment, the following effects can be obtained.

1. A plurality of the liquid containers 37 for containing liquid are mounted on the carriage 32 in such a manner the liquid containers 37 are arranged side by side in the depth direction. Thereby, the width of the apparatus (housing 12) can be reduced compared with an apparatus in which the liquid containers 37 are arranged in the width direction. In addition, although the carriage 32 becomes longer in the depth direction due to a plurality of the liquid containers 37 mounted thereon, disposing a portion of the carriage 32 at a position overlapping the waste liquid containing portion 19 in the vertical direction can suppress an increase in the size of the apparatus in the depth direction. Thus, the increase in the size of the apparatus caused by disposing the waste liquid containing portion 19 can be suppressed. Note that the increase in the size of the apparatus in the depth direction can be efficiently suppressed by making the front edge or rear edge of the carriage 32 overlap the waste liquid containing portion 19 in the vertical direction when the liquid ejecting head 31 is outside the transport path 28.

2. The increase in the size of the carriage 32 can be suppressed by making the liquid ejecting head 31 protrude from the bottom of the carriage 32 and by disposing the liquid ejecting head 31 protruding from the carriage 32 side by side with the waste liquid containing portion 19 in the depth direction when the liquid ejecting head 31 is outside the transport path 28. Thus, the height of the apparatus can be reduced by reducing the vertical distance between the carriage 32 and the waste liquid containing portion 19.

3. If the whole portion of the carriage 32 is disposed outside the transport path 28 when the liquid ejecting head 31 is outside the transport path 28, then the length of the movement path 34 of the carriage 32 inevitably becomes larger, leading to an increase in the size of the apparatus (housing 12) in the width direction. However, the increase in the size of the apparatus in the width direction can be suppressed by making a widthwise end edge of the carriage 32 overlap the transport path 28 when the liquid ejecting head 31 is outside the transport path 28.

4. The size of the carriage 32 is increased in the depth direction by mounting, on the carriage 32, the liquid containers 37 that are arranged side by side in the depth direction. In this case, the increase in the height and the width of the apparatus (housing 12) can be suppressed by arranging the waste liquid containing portion 19, the liquid receiving portion 42, and the suction mechanism 43 side by side in the depth direction.

5. Disposing the operating portion 36 on the first end side of the mounting portion 35 causes the size of the carriage 32 to increase toward the first end side, thereby extending the length of the movement path 34 of the carriage 32 between the transport path 28 and the first end. However, even if the carriage 32 increases in size toward the first end, the length of the movement path 34 between the transport path 28 and the second end does not need to increase, by making the expanded portion of the carriage 32 overlap the transport path 28 in the vertical direction when the liquid ejecting head 31 is in between the transport path 28 and the second end. Thus, the increase in the size of the apparatus body toward the second end can be suppressed.

6. The waste liquid containing portion 19 has the waste liquid container 50 that is detachably installed in the installation room 18. Thus, replacing the waste liquid container 50 can increase the amount of waste liquid to be received. Thus, it is not necessary to increase the size of the waste liquid containing portion 19 in order to increase the amount of waste liquid to be received. In addition, the waste liquid container 50 is installed from the front side in the depth direction, which improves operability when the waste liquid container 50 is replaced.

The above described embodiment may be altered into modification examples as described below. In addition, each configuration included in the embodiment can be arbitrarily combined with each included in the modification examples below. The configurations included in the modification examples below may be arbitrarily combined with each other.

The waste liquid containing portion 19 may be a container fixedly disposed in the housing 12, instead of including the detachable waste liquid container 50. An adapter for connecting the connection pipe 61*a*, via a waste liquid tube, to a waste liquid tank that is provided outside the housing 12 may be installed in the installation room 18, instead of providing the waste liquid container 50.

The whole portion of the waste liquid containing portion 19 need not be installed within the rectangularly shaped housing 12. For example, a portion of the housing 12 may be made to protrude in the width direction, and the protrusion may accommodate a portion of the installation room 18. In this case, a portion of the waste liquid containing portion 19 is located outside the movement path 34 of the carriage 32 in the width direction. Alternatively, a portion of the housing 12 may be made to protrude from the front side or rear side thereof, and the protrusion may accommodate a portion of the installation room 18. Moreover, a portion of the waste liquid container 50 installed in the installation room 18 may be made to protrude in the width direction, or protrude forward or backward, from the installation room 18 or the housing 12. In this case, the amount of waste liquid to be contained can be increased without modifying the arrangement of the movement path 34 and other elements.

A portion (lower rear portion) of the waste liquid containing portion 19 may be made to protrude into the space between the mounting frame 39 and the bottom wall 12*b*. In this case, the protruding portion of the waste liquid containing portion 19 is made to overlap the maintenance unit 40 in the vertical direction so that the amount of waste liquid to be contained can be increased.

The waste liquid container 50 may be detachably installed in the installation room 18 that opens in the width direction by moving the waste liquid container 50 in the width direction. Alternatively, the waste liquid container 50 may be detachably installed in the installation room 18 that opens backward by moving the waste liquid container 50 toward the front side in the depth direction. The waste liquid containing portion 19, into which the waste liquid container 50 is detachably installed from behind, may be made to overlap the rear edge of the carriage 32 in the vertical direction when the liquid ejecting head 31 is outside the transport path 28 (for example, at the home position). In this case, the installation or removal suitable for the layout requirements of each configuration can be implemented without changing the arrangement of the movement path 34 and other elements.

Figure 5:
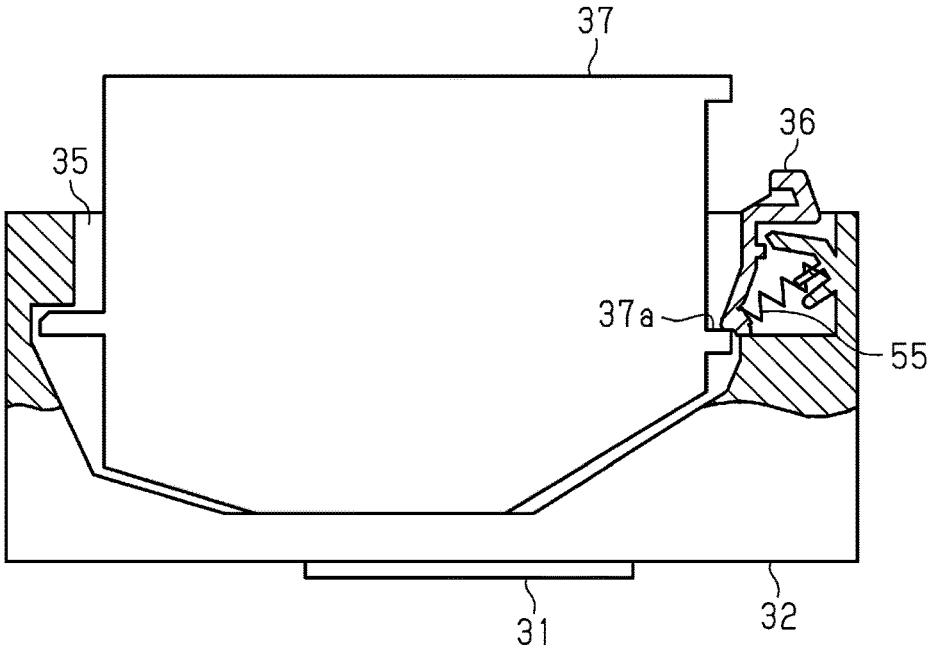
FIG. 5 is a partial sectional view illustrating a carriage having an operating portion.

As illustrated in FIG. 5, the operating portion 36, such as a lever, may be engaged with an engaging portion 37*a* that is disposed in each of the liquid containers 37 while the engaging portion 37*a* is urged by an urging member 55 that is disposed between the engaging portion 37*a* and the mounting portion 35.

Figure 6:
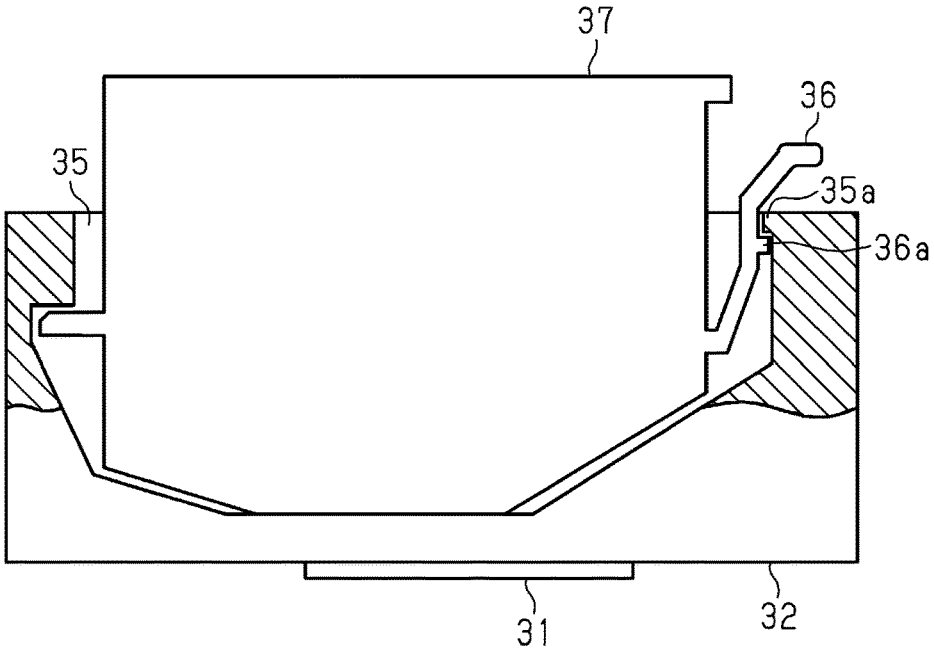
FIG. 6 is a partial sectional view illustrating a carriage in which a liquid container having an operating portion is installed.

As illustrated in FIG. 6, each liquid container 37 may be formed so as to have an operating portion 36 capable of elastic deformation. Thus, the liquid container 37 may be installed while an engaging portion 36*a* disposed in the operating portion 36 is engaged with a locking portion 35*a* disposed in the mounting portion 35. In this case, it is preferable that the operating portion 36 of the liquid container 37 that is mounted on the mounting portion 35 be disposed at the first end side of the mounting portion 35.

A portion of the liquid container 37 mounted on the mounting portion 35 may protrude from the carriage 32 as illustrated in FIGS. 5 and 6, or alternatively the whole portion of the liquid container 37 may be contained in the carriage 32. Moreover, as illustrated in FIGS. 5 and 6, a portion of the bottom of the carriage 32 may be flat and need not protrude.

The number of the liquid containers 37 mounted on the mounting portion 35 may be one or more than one (for example, four). In any case, it is assumed that the depth of the mounting portion 35 is longer than the width, and thereby the depth of the carriage 32 becomes longer than the depth of the liquid ejecting head 31. It is also assumed that the depth of the carriage 32 is longer than that of the liquid ejecting head 31, irrespective of the size of the mounting portion 35 or the position of the operating portion 36. In the case of the carriage 32 having a long depth, it is preferable that a portion of the carriage 32 overlap the waste liquid containing portion 19 in the vertical direction.

The liquid ejecting apparatus 11 according to the embodiment is an on-carriage type apparatus in which the liquid containers 37 are mounted on the carriage 32. However, an off-carriage type apparatus in which the liquid containers 37 are disposed at a predetermined position distant from the carriage 32 within the housing 12 can also be adopted. In the case of adopting the off-carriage type liquid ejecting apparatus 11, the waste liquid container 50 and the liquid containers 37 may be disposed side by side in the depth direction at a widthwise end of the housing 12. In this case, the waste liquid container 50 may be disposed on the front side, or the liquid containers 37 may be disposed on the front side. Further in this case, either of the waste liquid container 50 or the liquid containers 37, or both of them, may protrude outside the movement path 34 in the width direction. A portion of the waste liquid container 50 or the liquid containers 37, which protrude as such, may be accommodated by making a portion of the rectangularly shaped housing 12 protrude. This can increase the amount of liquid contained in the liquid containers 37 and the amount of waste liquid contained in the waste liquid container 50 while suppressing an increase in the size of the whole apparatus. Note that when the waste liquid container 50 and the liquid containers 37 are disposed in such a manner as to arrange them in the depth direction, the one positioned on the rear side may be detachably installed by moving it from the rear side or in the width direction while the one positioned on the front side may be detachably installed by moving it from the front side or in the width direction. In any case, installation and removal to and from the liquid ejecting apparatus 11 are made easier.

In the case of adopting the off-carriage type liquid ejecting apparatus 11, the waste liquid container 50 and the liquid containers 37 may also be disposed side by side in the vertical direction at a widthwise end of the housing 12. In this case, the waste liquid container 50 may be disposed on top of the liquid containers 37, or may be disposed vice versa. Further in this case, either of the waste liquid container 50 or the liquid containers 37, or both of them, may also protrude outside the movement path 34 in the width direction. A portion of the waste liquid container 50 or the liquid containers 37, which protrude as such, may be accommodated by making a portion of the rectangularly shaped housing 12 protrude. This can increase the amount of liquid contained in the liquid containers 37 and the amount of waste liquid contained in the waste liquid container 50 while suppressing an increase in the size of the whole apparatus. Note that when the waste liquid container 50 and the liquid containers 37 are disposed in such a manner as to arrange them in the vertical direction, at least either of them may be detachably installed by moving it from the front side or in the width direction. This makes easier the installation and removal to and from the liquid ejecting apparatus 11.

When the depth of the carriage 32 is longer than that of the liquid ejecting head 31, it is also preferable for the off-carriage type, as is for the on-carriage type, that at least one of the waste liquid container 50 and the liquid containers 37 be disposed at a position overlapping the carriage 32 in the vertical direction. This efficiently suppresses the increase in the size of the apparatus in the depth direction.

A medium S (for example, A4 size paper) contained in the media cassette 21 may be transported sideways on the transport path 28 with the longitudinal direction of the medium S being aligned with the width direction or may be transported lengthwise with the longitudinal direction of the medium S being aligned with the depth direction.

A plurality of media cassettes 21 may be installed in the housing 12, or a manual feed mechanism may be provided to supply media S manually, instead of installing the media cassette 21. Moreover, the liquid ejecting apparatus 11 may include both of the media cassette 21 and the manual feed mechanism.

The liquid that the liquid ejecting head ejects is not limited to ink but may be, for example, a liquid-state material made by dispersing or mixing particles of a functioning material in liquid. For example, the liquid ejecting head can be formed so as to print by ejecting a liquid-state material that contains, in the form of a dispersion or melt, an electrode material, a coloring material (pixel material), etc., to be used, for example, for manufacturing liquid crystal displays, Electro Luminescence (EL) displays, surface light emission displays.

The medium S is not limited to a sheet of paper but may be a plastic film, a thin board material, etc., or may be a piece of cloth to be used for a cloth-printing apparatus, etc. Moreover, the medium S need not only be a cut sheet cut into a predetermined dimension but may be, for example, a roll-like medium rolled like a cylinder, or may be an arbitrarily-shaped piece of clothing or the like, such as a T-shirt, or may be an arbitrarily-shaped three-dimensional object, such as a piece of tableware or stationery.

The entire disclosure of Japanese Patent Application No. 2016-133992, filed Jul. 6, 2016 is expressly incorporated by reference herein.

What is claimed is:

1. A liquid ejecting apparatus, comprising:

a liquid ejecting head ejecting liquid onto a medium transported on a transport path extending in a depth direction;

a carriage holding the liquid ejecting head and reciprocally moving in a width direction so as to cross the transport path; and a waste liquid containing portion containing waste liquid discharged from the liquid ejecting head, wherein the carriage includes a plurality of liquid containers that contain the liquid and are mounted on the carriage in such a manner that the plurality of the liquid containers are arranged side by side with each other in the depth direction, and a portion of the carriage overlaps the waste liquid containing portion in a vertical direction when the liquid ejecting head is outside the transport path.

2. The liquid ejecting apparatus according to claim 1, wherein the liquid ejecting head protrudes downward from a bottom of the carriage, and wherein a portion of the liquid ejecting head overlaps the waste liquid containing portion in the depth direction when the liquid ejecting head is outside the transport path.

3. The liquid ejecting apparatus according to claim 1, further comprising a liquid receiving portion, wherein the liquid ejecting head has a nozzle that ejects the liquid, the liquid receiving portion is disposed outside the transport path and receives the liquid discharged from the nozzle, and the carriage has an end in the width direction and the end overlaps the transport path in the vertical direction when the nozzle is at a position opposing the liquid receiving portion.

4. The liquid ejecting apparatus according to claim 1, further comprising a liquid receiving portion and a suction mechanism, wherein the liquid ejecting head has a nozzle that ejects the liquid, the liquid receiving portion is disposed outside the transport path and receives the liquid discharged from the nozzle, the suction mechanism sucks the liquid from the liquid ejecting head via the liquid receiving portion, and the suction mechanism and the waste liquid containing portion are disposed at positions sandwiching the liquid receiving portion in the depth direction.

5. The liquid ejecting apparatus according to claim 1, wherein the carriage has a mounting portion in which the liquid containers are detachably mounted and an operating portion used for installation and removal of each of the liquid containers, the carriage moves reciprocally between a first end and a second end of a movement path that crosses the transport path, and the operating portion is disposed at a first end side of the mounting portion.

6. The liquid ejecting apparatus according to claim 1, wherein the carriage has a mounting portion on which the liquid containers are detachably mounted and moves reciprocally between a first end and a second end of a movement path that crosses the transport path, each of the liquid containers has an operating portion used for installation and removal of each of the liquid containers on the mounting portion, and the operating portion of each of the liquid containers that are mounted on the mounting portion is disposed at a first end side of the mounting portion.

7. The liquid ejecting apparatus according to claim 1, wherein the waste liquid containing portion includes a waste liquid container that contains the waste liquid and an installation portion in which the waste liquid container is detachably installed, wherein the installation portion is provided in a front side in the depth direction.

8. The liquid ejecting apparatus according to claim 1, wherein the depth direction crosses the width direction.

9. The liquid ejecting apparatus according to claim 1, wherein a front side in the depth direction of the carriage overlaps with the waste liquid containing portion in the vertical direction when the liquid ejecting head is outside the transport path.

* * * * *